US009133805B2

(12) United States Patent
Uhlmann

(10) Patent No.: US 9,133,805 B2
(45) Date of Patent: Sep. 15, 2015

(54) FUEL INJECTOR FOR AN INTERNAL COMBUSTION ENGINE

(75) Inventor: Dietmar Uhlmann, Korb (DE)

(73) Assignee: Robert Bosch GmbH, Stuttgart (DE)

( * ) Notice: Subject to any disclaimer, the term of this patent is extended or adjusted under 35 U.S.C. 154(b) by 540 days.

(21) Appl. No.: 13/389,344

(22) PCT Filed: Jul. 19, 2010

(86) PCT No.: PCT/EP2010/060411

§ 371 (c)(1),
(2), (4) Date: Feb. 7, 2012

(87) PCT Pub. No.: WO2011/023466

PCT Pub. Date: Mar. 3, 2011

(65) Prior Publication Data

US 2012/0138019 A1 Jun. 7, 2012

(30) Foreign Application Priority Data

Aug. 28, 2009 (DE) ..... 10 2009 028 979

(51) Int. Cl.
*F02M 47/02* (2006.01)
*F02M 63/00* (2006.01)
*F02M 55/00* (2006.01)

(52) U.S. Cl.
CPC ..... *F02M 63/0026* (2013.01); *F02M 47/027* (2013.01); *F02M 55/002* (2013.01);
(Continued)

(58) Field of Classification Search
CPC ..... F02M 37/0052; F02M 47/027; F02M 63/0007; F02M 63/0026; F02M 2457/001; F02M 61/1806; F02M 55/002; F02M 55/004; F02M 55/008; F02M 65/006; F02M 19/0232
USPC ..... 701/103, 104; 123/445, 472, 467.514; 239/586, 596, 597, 598, 533.2, 88–92, 239/96, 533.8, 124
See application file for complete search history.

(56) References Cited

U.S. PATENT DOCUMENTS 5,265,804 A * 11/1993 Brunel ..... 239/88
5,803,369 A * 9/1998 Toyao et al. ..... 239/533.8
(Continued)

FOREIGN PATENT DOCUMENTS

DE 102007013249 A1 * 9/2008 ..... F02M 47/027
DE 102007040115 2/2009
(Continued)

OTHER PUBLICATIONS

PCT/EP2010/060411 International Search Report, 2 pages.

*Primary Examiner* — Stephen K Cronin
*Assistant Examiner* — Brian Kirby
(74) *Attorney, Agent, or Firm* — Michael Best & Friedrich LLP

(57) ABSTRACT

The invention relates to a fuel injector comprising an actuator module 2 arranged in a holding body 1, wherein the holding body 1 is braced by means of a tension nut 13 to a nozzle body 12 by means of at least one interposed intermediate body designed as a throttle plate 11, wherein the throttle plate 11 is penetrated by at least one high pressure channel 16, an inflow channel 18 having an inflow throttle, and an outflow channel 19 having an outflow throttle, and wherein a valve actuated by the actuator module 2, said valve having at least one valve pin 4 and a sealing sleeve 5, is arranged between the actuator module 2 and the throttle plate 11, forming a leakage chamber 21 facing the throttle plate 11. According to the invention, a fuel injector is provided, wherein the leakage discharge out of the leakage chamber 21 is ensured without impairing the tightness of the fuel injector in the areas adjacent to the throttle plate 11. This is achieved in that a horizontal leakage outlet channel 20, which extends from the cylindrical outer circumference of the throttle plate 11 to a region underneath the leakage chamber 21 and is hydraulically connected to the leakage chamber 21 by way of a leakage channel 22, is recessed in the throttle plate 11.

6 Claims, 3 Drawing Sheets

(52) U.S. Cl.
CPC ..... *F02M55/004* (2013.01); *F02M 55/008* (2013.01); *F02M 63/007* (2013.01); *F02M 63/0031* (2013.01); *F02M 2200/16* (2013.01)

(56) References Cited

U.S. PATENT DOCUMENTS

| | | | | |
|---|---|---|---|---|
| 5,893,516 | A * | 4/1999 | Harcombe et al. | 239/95 |
| 6,027,037 | A * | 2/2000 | Murakami et al. | 239/88 |
| 6,119,962 | A * | 9/2000 | Youakim et al. | 239/124 |
| 6,237,570 | B1 * | 5/2001 | Aoki et al. | 123/467 |
| 6,471,142 | B1 * | 10/2002 | Lambert | 239/88 |
| 6,648,248 | B2 * | 11/2003 | Adachi et al. | 239/585.1 |
| 6,945,475 | B2 * | 9/2005 | Lawrence et al. | 239/533.2 |
| 6,955,114 | B2 * | 10/2005 | Stockner et al. | 91/417 R |
| 7,051,958 | B2 * | 5/2006 | Sander-Potz et al. | 239/533.2 |
| 7,059,301 | B2 * | 6/2006 | Stockner et al. | 123/446 |
| 7,455,243 | B2 * | 11/2008 | Coldren et al. | 239/5 |
| 7,464,882 | B2 * | 12/2008 | Kanamori | 239/96 |
| 7,621,258 | B2 * | 11/2009 | Heinz et al. | 123/467 |
| 7,703,708 | B2 * | 4/2010 | Matsumoto | 239/533.3 |
| 8,113,176 | B2 | 2/2012 | Rossignol et al. | |
| 8,662,411 | B2 * | 3/2014 | Gruenberger | 239/88 |
| 2002/0174854 | A1 * | 11/2002 | Lei | 123/446 |
| 2003/0075614 | A1 * | 4/2003 | Schuerg et al. | 239/102.1 |
| 2004/0055562 | A1 * | 3/2004 | Stewart et al. | 123/299 |
| 2008/0257980 | A1 * | 10/2008 | Magel | 239/89 |
| 2008/0315009 | A1 * | 12/2008 | Coldren et al. | 239/88 |

FOREIGN PATENT DOCUMENTS

| | | | | |
|---|---|---|---|---|
| DE | 102008042158 | A1 * | 3/2010 | |
| DE | 102009026564 | A1 * | 12/2010 | |
| EP | 1288486 | | 3/2003 | |
| JP | 2003083203 | | 3/2003 | |
| WO | WO2008/049669 | * | 5/2008 | F02M 47/027 |
| WO | 2008113630 | | 9/2008 | |
| WO | WO2009/130065 | * | 10/2009 | F02M 47/027 |

* cited by examiner

FUEL INJECTOR FOR AN INTERNAL COMBUSTION ENGINE

BACKGROUND OF THE INVENTION

The invention relates to a fuel injector having an actuator module arranged in a holding body, wherein the holding body is clamped by means of a clamping nut to a nozzle body with at least one interposed intermediate body designed as a restrictor plate, wherein the restrictor plate is penetrated by at least one high pressure channel, by an inflow channel having an inflow restrictor and by an outflow channel having an outflow restrictor, and wherein a valve actuated by the actuator module, said valve having at least one valve pin and a sealing sleeve, is arranged between the actuator module and the restrictor plate, so as to form a leakage space facing the restrictor plate.

A fuel injector of this kind is known from DE 10 2007 040 115 A1. The construction of this fuel injector is as described above, wherein the permanent leakage quantity of fuel generated between the centering pin and the sealing sleeve is accommodated in the leakage space. This permanent leakage quantity is discharged from the leakage space into a low pressure system or return system via an outflow line. In this fuel injector, the outflow line is machined into the restrictor plate, into the sealing surface between the restrictor plate and the holding body accommodating the actuator module and the valve.

EP 1 288 486 A2 has disclosed another fuel injector, in which the intermediate body is designed as a high pressure body. At least one annular leakage channel is machined into this high pressure body, said channel surrounding the passage of the high pressure channel through the high pressure body. This annular leakage channel is arranged in such a way that, allowing for the resulting surface pressures, reliable sealing of the mutually adjacent components is obtained.

SUMMARY OF THE INVENTION

It is the underlying object of the invention to provide a fuel injector in which discharge of the leakage from the leakage space is ensured without impairing the leaktightness of the fuel injector in the adjacent regions to the restrictor plate.

This object is achieved by virtue of the fact that a horizontal leakage outflow channel, which extends from the cylindrical outer circumference of the restrictor plate to a region underneath the leakage space and is hydraulically connected to the leakage space by way of a leakage channel, is let into the restrictor plate.

Introducing the leakage outflow channel into the restrictor plate significantly improves the leaktightness of the fuel injector in the adjacent regions to the restrictor plate, as compared with known solutions. In a very general embodiment, the leakage channel is preferably arranged vertically directly below the leakage space and the fuel to be discharged is discharged in a suitable manner from the mouth of the leakage outflow channel to the cylindrical outer circumference of the restrictor plate.

In a further embodiment of the invention, a leakage discharge channel, which is hydraulically connected to the leakage outflow channel, is let into the restrictor plate, said discharge channel being arranged adjacent to the outer circumference of said restrictor plate. This leakage discharge channel is likewise arranged vertically and, in a further embodiment, opens into an annular space arranged between the restrictor plate and a valve body accommodating the valve. In this arrangement, the annular space can be let into the restrictor plate and/or the valve body. The valve body can be designed as a further separate intermediate body or as part of the holding body. From the annular space, the leakage fuel is discharged into a low pressure system or return system via an outflow line.

In a further embodiment of the invention, the leakage outflow channel is a leakage outflow bore which, in turn, in a further embodiment, has a diameter of at least approximately 1.2 mm. This embodiment is based on the insight that the target values for the required surface pressure in the end face region of the restrictor plate above and below the outflow channel, which are, for example, one and a half times the pressure in a rail that supplies the fuel injector with fuel, may not be reached in certain circumstances. However, penetration of the pressure under the sealing surface in these opposite regions must be excluded during operation of the injector. However, embodiment as a leakage outflow bore with the small diameter indicated ensures that there is little or no negative effect on the surface pressure. Moreover, the surface pressure is applied to the interposed components by means of the clamping nut screwed to the holding body. In principle, it would also be conceivable to make the bore with an even smaller diameter. However, this is not advisable because of the deburring processes for the leakage channel and the leakage discharge channel since then reliable removal of the metal deburring fragments would not be guaranteed.

In a development of the invention, a sleeve extending between the leakage channel and the leakage discharge channel is inserted into the leakage outflow channel or the leakage outflow bore. This sleeve compensates for the local loss of rigidity which may occur in the restrictor plate, and further increases the local surface pressure levels at the corresponding end faces. The extension of the sleeve between the leakage channel and the leakage discharge channel guarantees that the entire region to be sealed off has a sufficiently high surface pressure radially. The sleeve can be manufactured from the same ferrous material as the restrictor plate but it is also possible to manufacture the sleeve from a higher-grade ferrous material, in particular a stronger ferrous material. After the deburring processes on the leakage channel and the leakage discharge channel, the sleeve is press-fitted into the leakage discharge channel.

In a further embodiment of the invention, the sleeve has an inside diameter of 0.6 mm. This diameter is sufficient to ensure that there is no restriction of the leakage quantity fed through.

In a development of the invention, the leakage outflow channel or leakage outflow bore is arranged on the opposite side of the restrictor plate from the high pressure channel. This side is recommended since the restrictor plate is free from further apertures in this region.

Further advantageous embodiments of the invention can be found in the description of the drawings, in which an embodiment illustrated in the figures is described in detail.

DETAILED DESCRIPTION

Figure 1:
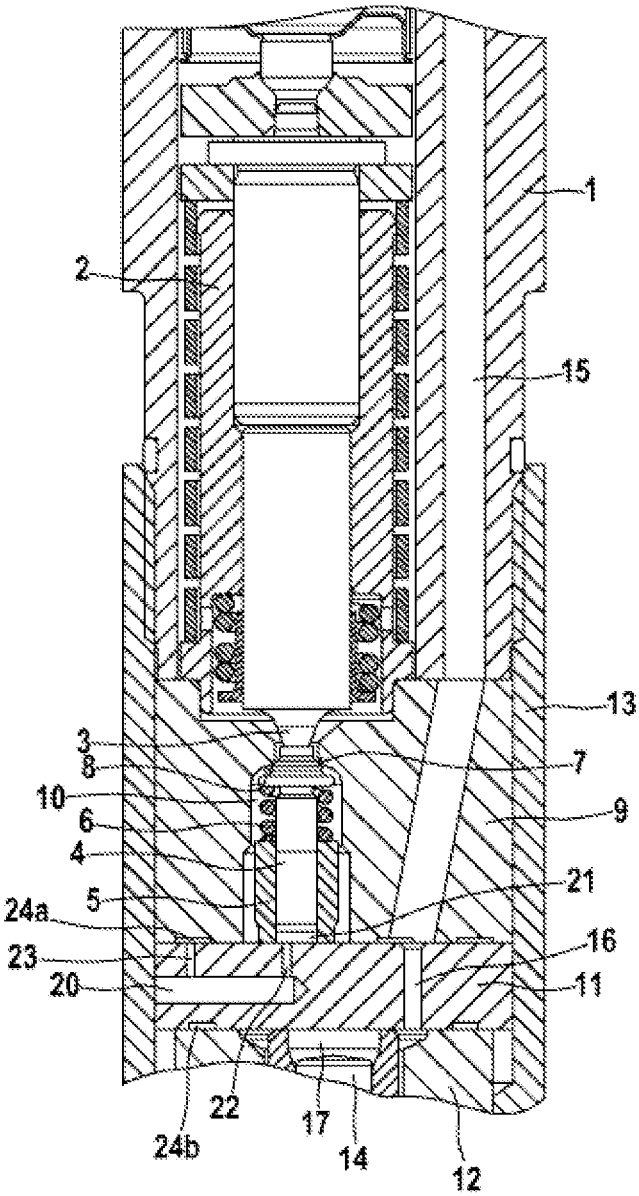
FIG. 1 shows a cross section of a portion of a fuel injector for a ommon rail system of a diesel injection system at the control-valve end.

FIG. 1 shows a portion of a fuel injector for a common rail system of a diesel injection system at the control-valve end. An electrically actuated actuator module 2 is inserted in a holding body 1, said actuator module being actuated by an electronic engine control unit in accordance with operator requirements. The actuator module 2 is preferably a piezoactuator, which is in an inoperative state in the illustration.

By means of an actuating nose 3, the actuator module 2 interacts with a valve pin 4, which is arranged in a sealing sleeve 5 in such a way that it can be moved longitudinally against the force of a valve spring 6. The valve pin 4 has a sealing surface 7 which, when the valve is closed, interacts sealingly with a seat surface 8 machined into a valve plate 9. A valve space 10 is formed in the valve plate 9 underneath the seat surface 8, said valve space partially surrounding the sealing sleeve 5, which is inserted securely in the valve plate 9, and extending as far as a restrictor-plate end of the valve plate 9.

In the operative state of the actuator module 2, the actuating nose 3 moves the valve pin 4 in the direction of the restrictor plate 11 adjoining the valve plate 9 and raises the sealing surface 7 of the valve pin 4 from the seat surface 8 of the valve plate 9, and a flow connection is thus formed between the valve space 10 and a low pressure space, which is formed in the holding body 1 and which is part of a fuel return system.

Adjoining the restrictor plate 11 is a nozzle body 12, which is clamped firmly to the holding body 1 by means of a clamping nut 13, enclosing the restrictor plate 11 and the valve plate 9. A nozzle needle, which is not shown in detail, with only an end region of a nozzle needle plunger 14 of the nozzle needle being visible, is guided in the nozzle body 12 in such a way that it can be moved axially. The nozzle needle plunger 14 delimits a control space 17, which is delimited at the opposite end from the nozzle needle plunger 14 by the restrictor plate 11. Opening into this control space 17 is an inflow channel 18 (FIG. 2) with an inflow restrictor arranged therein and an outflow channel 19 (FIG. 2) with an outflow restrictor arranged therein. The inflow channel 18 is to a high pressure line 15, via which fuel, in particular diesel fuel, is fed via a high pressure channel 16 in the restrictor plate 11 to a nozzle needle pressure space, which will be explained below. The outflow channel 19 connects the control space 17 to the valve space 10, with the result that the fuel pressure prevailing in the high pressure line 15, e.g. 2000 bar, prevails in the valve space 10, the control space 17 and the nozzle needle pressure space in the state of rest.

In order to inject fuel into the combustion chamber of the internal combustion engine which is associated with a fuel injector, the nozzle needle must be moved from a closed position to an open position. The fuel then passes from the nozzle needle pressure space, via injection channels in the nozzle body, into the combustion chamber. To open the nozzle needle, the nozzle needle plunger 14 must be moved in the direction of the restrictor plate 11.

To bring about this movement, the actuator module 2 is operated. The sealing surface 7 of the valve pin 4 is raised from the seat surface 8, and the fuel in the valve space 10 can flow off into the low pressure space, thus reducing the fuel pressure prevailing in the valve space 10. Fuel also flows off from the control space 17 through the outflow channel 19, with the result that a pressure reduction is also brought about in the control space 17, triggering the movement of the nozzle needle plunger 14 in the direction of the restrictor plate 11.

If the actuator module 2 is deenergized again, the sealing surface 7 is moved back onto the seat surface 8, and the fuel pressure in the control space 17 and also in the valve space 10 is increased again, by means of the additional fuel flowing through the inflow channel 18, to a pressure sufficient to move the nozzle needle plunger 14 and hence the nozzle needle into the closed position.

In order to discharge the permanent leakage quantity of fuel generated between the valve pin 4 and the sealing sleeve 5 in a leakage space 21 underneath the valve pin 4, a horizontal leakage outflow channel 20 is machined into the restrictor plate 11, said channel being connected to the leakage space 21 by a vertical leakage channel 22. The leakage fuel is discharged from the leakage outflow channel 20, via a leakage discharge channel 23, into an annular space 24*a*, which is machined into the valve plate 9 and is connected to the low pressure system. Another annular space 24*b* is machined into the restrictor plate 11 on the opposite side from the annular space 24*a*.

Figure 2:
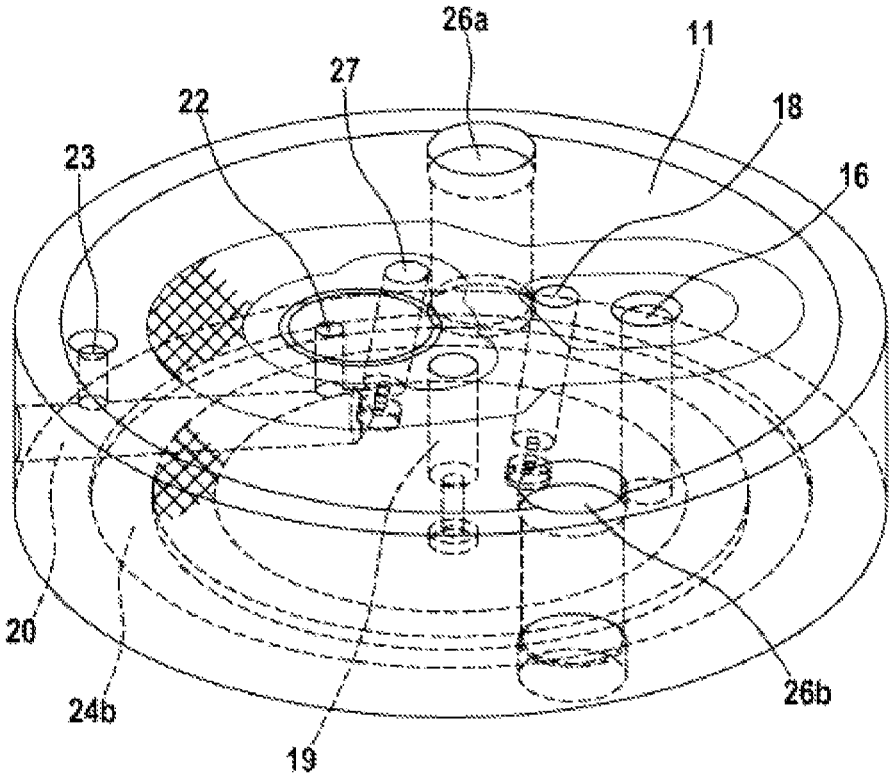
FIG. 2 shows a perspective view of the restrictor plate.

FIG. 2 shows a perspective view of the restrictor plate 11 with the leakage outflow channel 20 and the leakage channel 22 and leakage discharge channel 23 opening into it. Arranged on the opposite side is the high pressure channel 16, while two pin bores 26*a*, 26*b* are arranged approximately at a right angle to an imaginary connecting line between the leakage outflow channel 20 and the high pressure channel 16, eccentrically with respect to the center of the restrictor plate 11. Fixing pins are inserted into these pin bores 26*a*, 26*b*, said fixing pins engaging in corresponding bores in the nozzle body 12 and, penetrating the valve plate 9 in the process, in the holding body 1. This ensures that the fuel injector is mounted securely in position and securely against rotation. In addition to the inflow channel 18 and the outflow channel 19, a filling channel 27 with a filling restrictor is furthermore machined into the restrictor plate 11. All these channels are designed as bores, wherein the respectively associated restrictors can be inserted into the bores as separate components or, alternatively, can be produced together with the bores by means of appropriate boring techniques. The hatched areas above and below the leakage outflow channel 20 represent the regions in which the surface pressure on the underside of the restrictor plate and on the upper side of the restrictor plate reaches the predetermined target values by virtue of the embodiment according to the invention of the leakage outflow channel 20.

Figure 3:
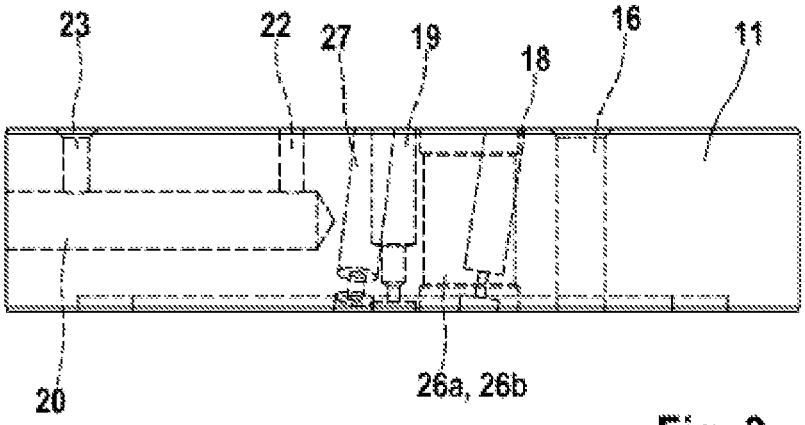
FIG. 3 shows a side view of the restrictor plate with all the channels in the restrictor plate and with an outflow bore without a sleeve inserted.
Figure 4:
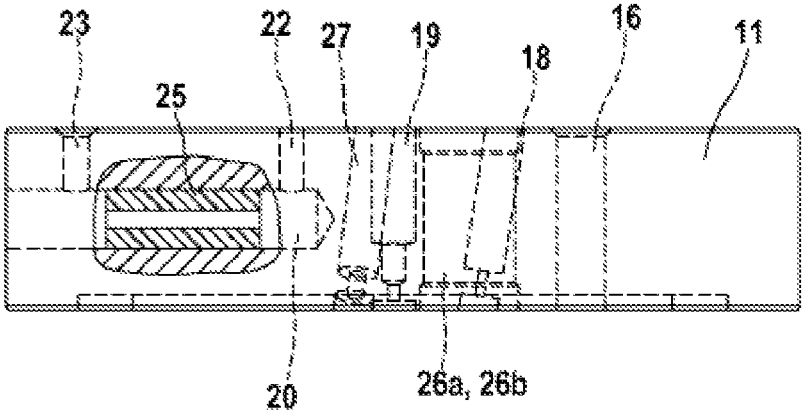
FIG. 4 shows a side view of the restrictor plate with all the channels in the restrictor plate and with a sleeve inserted into the outflow bore.

FIG. 3 shows a side view of the restrictor plate 11 with all the channels/or bores in the restrictor plate 11. In this figure, the leakage outflow channel 20 is designed without a sleeve while, in the corresponding FIG. 4, a sleeve 25 is inserted into the leakage outflow channel 1. The sleeve 25 has an inside diameter of about 0.6 mm and extends between the leakage channel 22 and the leakage discharge channel 23.

The invention claimed is:

1. A fuel injector having an actuator module (2) arranged in a holding body (1), wherein the holding body (1) is clamped to a nozzle body (12) with at least one interposed intermediate body designed as a restrictor plate (11), wherein the restrictor plate (11) includes at least one high pressure channel (16) and an outflow channel (19) having an outflow restrictor, and wherein a valve actuated by the actuator module (2), said valve having at least one valve pin (4) and a sealing sleeve (5), is arranged between the actuator module (2) and the restrictor plate (11), so as to form a leakage space (21) facing the restrictor plate (11), characterized in that a horizontal leakage outflow channel (20), which extends from a cylindrical outer circumference of the restrictor plate (11) to a region underneath the leakage space (21) and is hydraulically connected to the leakage space (21) by way of a leakage channel (22), is provided in the restrictor plate (11), wherein a leakage discharge channel (23), which is hydraulically connected downstream of the leakage space (21) to the horizontal leakage outflow channel (20), is provided in the restrictor plate (11), said leakage discharge channel being arranged adjacent to the outer circumference of said restrictor plate, and wherein the leakage discharge channel (23) opens into an annular space (24*a*) that is machined into a valve plate (9) and connected to a leakage discharge system.

2. The fuel injector as claimed in claim 1, characterized in that the horizontal leakage outflow channel (20) is an outflow bore.

3. The fuel injector as claimed in claim 1, characterized in that the horizontal leakage outflow channel (20) has a diameter of 1.2 mm.

4. The fuel injector as claimed in claim 1, characterized in that a sleeve (25) extending between the leakage channel (22) and the leakage discharge channel (23) is inserted into the horizontal leakage outflow channel (20).

5. The fuel injector as claimed in claim 4, characterized in that the sleeve (25) has an inside diameter of 0.6 mm.

6. The fuel injector as claimed in claim 1, characterized in that the horizontal leakage outflow channel (20) is arranged on an opposite side of the restrictor plate (11) from the high pressure channel (16).

* * * * *